United States Patent [19]

Senoo et al.

[11] Patent Number: 4,877,688

[45] Date of Patent: Oct. 31, 1989

[54] INK-JET RECORDING SHEET

[75] Inventors: Hideaki Senoo, Tokyo; Takeshi Yamasaki; Yasuo Satoh, both of Funabashi; Mamoru Sugaya, Kawasaki, all of Japan

[73] Assignee: Mitsubishi Paper Mills, Ltd., Tokyo, Japan

[21] Appl. No.: 160,749

[22] Filed: Feb. 19, 1988

[30] Foreign Application Priority Data

Feb. 24, 1987 [JP] Japan ..... 62-40598

[51] Int. Cl.[4] ..... B41M 5/00

[52] U.S. Cl. ..... 428/522; 346/1.1; 346/135.1; 427/261; 428/195; 428/483; 428/913; 428/914

[58] Field of Search ..... 428/195, 211, 514, 913, 428/914, 483, 522; 346/1.1, 135.1; 427/261

[56] References Cited

U.S. PATENT DOCUMENTS 4,741,969 2/1988 Hayama et al. ..... 428/514

*Primary Examiner*—Ellis P. Robinson
*Assistant Examiner*—P. R. Schwartz
*Attorney, Agent, or Firm*—Armstrong, Nikaido, Marmelstein, Kubovcik & Murray

[57] ABSTRACT

An ink jet recording sheet which comprises a transparent support and, provided thereon, at least one ink-receiving layer which is a light transmission layer containing an emulsion polymerized composition can form a color image of high resolution and high color density and the recorded sheet is suitable for overhead projector.

5 Claims, No Drawings

INK-JET RECORDING SHEET

BACKGROUND OF THE INVENTION

The present invention relates to a recording medium which makes record with ink and more particularly it relates to an ink jet recording sheet suitable as light transmission recording medium for overhead projector and the like.

According to ink jet recording method, droplets of ink are projected by various means and applied onto a recording medium to make record of images or letters thereon. This recording system has rapidly spread in various uses as hard copy devices for various figures and color images including Chinese characters because of high versatility for patterns to be recorded and easy multicolor recording. Especially, overhead projectors as well as slide projectors are widely utilized for many conferences, lectures, promotional meetings and the marketing of commercial goods and there are many advantages in preparation of recording medium for overhead projectors by ink jet recording method.

Hitherto, record medium for overhead projectors have been prepared by utilizing opacification of transparent film due to heat shrinkage, by reprography, by thermal transfer method or by direct writing on transparent film by felt pen and the like. When recording on these transparent films is attempted by ink jet recording method, since the recording surface of the films has no ink absorbency, aqueous ink requires a long time for drying or flows thereon and thus practically usable recorded images cannot be obtained. As an approach to promote apparent drying of recorded image, an ink jet recording medium comprising a transparent support and provided thereon a porous layer comprising more than 60% by weight of filler particles and a resin binder was proposed in Japanese Patent Unexamined Publication (Kokai) No. 57-14091. However, since the binder is a resin soluble in organic solvents and besides more than 60% by weight of filler is used, completely transparent layer cannot be produced and thus the medium can be used for diazotype second original, but is unsatisfactory for overhead projectors.

When transparency is required as in recording sheets for overhead projectors, inorganic pigments cannot be used in a large amount and it is necessary to absorb and fix the ink with high molecular weight material alone.

With reference to the use of high molecular weight materials, there are disclosed, for example, polyvinyl pyrrolidone or polyvinyl pyrrolidone-vinyl acetate copolymer in Japanese Patent Unexamined Publication (Kokai) No. 57-38185, absorbing resins in Japanese Patent Unexamined Publication (Kokai) No. 57-17319, polymers having both the hydrophilic portion and hydrophobic portion in Japanese Patent Unexamined Publication (Kokai) No. 58-134784, copolymers of PVA and olefin or styrene and maleic anhydride in Japanese Patent Unexamined Publication (Kokai) No. 60-234879, use of two-layer structure consisting of ink-retention layer and ink-permeable layer, in Japanese Patent Unexamined Publication (Kokai) No. 6135276, use of cross-linked layer of ethylene oxide polymer with isocyanate compound in Japanese Patent Unexamined Publication (Kokai) No. 61-74879, use of materials comprising combination of carboxy-containing polymer and hydrophilic resin in Japanese Patent Unexamined Publication (Kokai) No. 61-102286, cationized PVA in Japanese Patent Unexamined Publication (Kokai) No. 61-272796, use of polyvinyl pyrrolidone having an average molecular weight of at least 100,000 in Japanese Patent Unexamined Publication (Kokai) No. 61-32788, use of an ink absorbing layer of a specific water-soluble resin and provided thereon a non-tacky water-soluble high molecular substance in Japanese Patent Unexamined Publication (Kokai) No. 61125878, use of a blend of carboxymethyl cellulose and polyethylene oxide in Japanese Patent Unexamined Publication (Kokai) No. 61-181679, use of modified PA having silyl group in Japanese Patent Unexamined Publication (Kokai) No. 61-134290 and use of graft polymer of methacrylamide on polyvinyl alcohol in Japanese Patent Unexamined Publication (Kokai) No. 61-132377.

As mentioned above, ink jet recording media are required to have properties such as absorbency of ink, especially aqueous ink and drying characteristics. Furthermore, for overhead projectors, the recording media are required to be superior in light transmission of support and ink-receiving layer. However, there have been provided no satisfactory recording media by the conventional high molecular weight materials and techniques.

SUMMARY OF THE INVENTION

An object of the present invention is to provide a recording sheet suitable as recording medium for overhead projectors which is improved in suitability for ink jet recording and has high absorbency especially for aqueous ink for ink jet recording, high speed drying property, high resolution and good light transmission.

The present invention provides an ink jet recording sheet which comprises a transparent support and provided thereon at least one ink-receiving layer which is a light transmission layer containing an emulsion polymerized composition obtained by emulsion polymerization, with 30–100 parts by weight of polyvinyl alcohol as an emulsifier, of (a) 100 parts by weight of a compound represented by the formula:

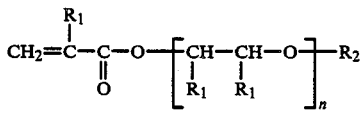

(I)

wherein $R_1$ represents a hydrogen atom, a methyl group, an ethyl group of a propyl group; $R_2$ represents a hydrogen atom or an alkyl group of 1–5 carbon atoms; and n represents an integer of 1–20, or (b) 100 parts by weight in total of the compound of the formula (I) and a compound represented by the formula:

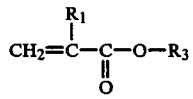

(II)

wherein $R_1$ is as defined above in formula (I) and $R_3$ represents an alkyl group of 1–18 carbon atoms, wherein amount of the compound of the formula (II) is not more than that of the compound of the formula (I).

DESCRIPTION OF THE PREFERRED EMBODIMENTS

The recording sheet of the present invention s characterized by having at least one light transmission ink-receiving layer prepared from a specific emulsion polymerized composition on a transparent support.

The emulsion polymerized composition is obtained compound represented by the formula (I):

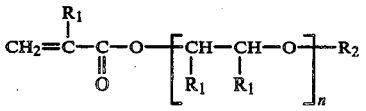

(I)

wherein $R_1$ represents a hydrogen atom, a methyl group, an ethyl group or a propyl group; $R_2$ represents a hydrogen atom or an alkyl group of 1–5 carbon atoms; and n represents an integer of 1–20, using 30–100 parts by weight of polyvinyl alcohol as an emulsifier or (b) 100 parts by weight in total of the compound represented by the formula (I) and a compound represented by the formula (II):

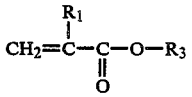

(II)

wherein $R_1$ is the same as defined above in the formula (I) and $R_3$ represents an alkyl group of 1–18 carbon atoms, with a proviso that amount of the compound of the formula (II) is not more than that of the compound of the formula (I), using 30–100 parts by weight of polyvinyl alcohol as an emulsifier.

As examples of the compound (monomer) of the formula (I), mention may be made of hydroxyethyl acrylate, hydroxyethyl methacrylate, hydroxypropyl acrylate, hydroxypropyl methacrylate, diethylene glycol acrylate, diethylene glycol methacrylate, dipropylene glycol acrylate, dipropylene glycol methacrylate, triethylene glycol acrylate, triethylene glycol methacrylate, tripropylene glycol acrylate, tripropylene glycol methacrylate, tetraethylene glycol acrylate, tetraethylene glycol methacrylate, tetrapropylene glycol acrylate, tetrapropylene glycol methacrylate, pentaethylene glycol acrylate, pentaethylene glycol methacrylate, pentapropylene glycol acrylate, pentapropylene glycol methacrylate, octaethylene glycol acrylate, octaethylene glycol methacrylate, octapropylene glycol acrylate, octapropylene glycol methacrylate, decaethylene glycol acrylate, decaethylene glycol glycol methacrylate, dodecaethylene glycol acrylate, dodecaethylene glycol methacrylate, dodecapropylene glycol acrylate, dodecapropylene glycol methacrylate, hexadecaethylene glycol acrylate, hexadecaethylene glycol methacrylate, hexadecapropylene glycol acrylate, hexadecapropylene glycol methacrylate, eicosaethylene glycol acrylate, eicosaethylene glycol methacrylate, eicosapropylene glycol acrylate, eicosapropylene glycol methacrylate and methyl or ethyl ethers thereof. The compound of the formula (I) may be used alone or in combination of two or more.

Furthermore, with the monomer of the formula (I) or mixture thereof may be copolymerized at least one of unsaturated carboxylic acids, unsaturated polybasic carboxylic acids or derivatives thereof such as, for example, acrylic acid, methacrylic acid, crotonic acid, maleic acid, fumaric acid, itaconic acid, maleic anhydride, maleic acid monoesters and fumaric acid monoesters. Addition amount of these monomers is not critical, but is preferably 30 wt. % or less for the compound of the formula (I).

As examples of the compound (monomer) of the formula (II), mention may be made of acrylic acid esters such as methyl acrylate, ethyl acrylate, butyl acrylate, isobutyl acrylate, 2-ethylhexyl acrylate and lauryl acrylate and methacrylic acid esters such as methyl methacrylate, ethyl methacrylate, butyl methacrylate, isobutyl methacrylate, 2-ethylhexyl methacrylate and lauryl methacrylate. These compounds of the formula (II) may be used alone or in combination of two or more.

Furthermore, with the monomer of the formula (II) or mixture thereof may be copolymerized at least one of vinyl esters such as, for example, vinyl acetate, vinyl propionate, vinyl laurate, vinyl stearate and vinyl carboxylates branched at α-position, unsaturated carboxylic acid esters or polybasic carboxylic acid esters such as, for example, methyl crotonate, ethyl crotonate, dibutyl maleate and diethyl fumarate, acrylonitrile, methacrylonitrile, styrene, methylstyrene, chlorostyrene, vinyl chloride, vinylidene chloride and ethylene. Addition amount of these monomers is not critical, but preferably is 30 wt. % or less for the compound of the formula (II).

Polymerization degree of polyvinyl alcohol (referred to as "PVA" hereinafter) has no special limitation, but is normally 50–3,000, preferably 100–2,500 and saponification degree is normally 50–100 mol. %, preferably 60–97 mol. %. The following water-soluble high molecular substances may be used in combination with PVA at the time of emulsion polymerization. Addition amount of the high molecular substance has no special limitation, but preferably is not more than that of PVA.

Vinyl type high molecular weight substances such as, for example, polyvinylmethyl ether, vinylmethyl ether/maleic anhydride copolymer and polyvinyl pyrrolidone;

Cellulose type high molecular weight substances such as, for example, methyl cellulose, ethyl cellulose, carboxymethyl cellulose and hydroxymethyl cellulose;

Animal and vegetable high molecular weight substances which afford transparent film upon drying such as, for example, starch, starch derivatives, casein and gelatin.

Furthermore, nonionic or anionic surfactants or mixtures thereof have the effect to increase wetting of films as support and these may be added at the time of emulsion polymerization or after completion of emulsion polymerization. Amount of these surfactants has no special limitation, but normally is within the range where they are generally used, preferably 10 wt. % or less, especially preferably 3 wt. % or less.

The emulsion polymerized composition which s a main component of the ink jet recording medium of the present invention is obtained by emulsion polymerization or copolymerization of monomer of the formula (I) or a mixture of monomers of the formulas (I) and (II) in aqueous phase using the above mentioned PVA as an emulsifier in the presence of a radical polymerization initiator and a pH adjustor and, if necessary, a chain transfer agent. Either batch type or continuous type polymerization may be employed. Polymerization reaction temperature is preferably 30°–90° C. As the radical polymerization initiator, there may be used water-soluble radical polymerization initiators normally used for emulsion polymerization, such as, for example, hydrogen peroxide, potassium persulfate, ammonium persulfate and butyl hydroperoxide alone or in combination with reducing agents such as, for example, 1-ascorbic acid, sulfites, Rongalit and ferrous sulfate, i.e., redox system. Addition amount of these polymerization initiators has no special limitation, but normally is within the range where they are generally used, preferably 1 wt. % or less.

As the pH adjustor, there may be used acids such as, for example, hydrochloric acid, phosphoric acid, acetic acid, succinic acid, boric acid and carbonic acid or salts thereof and bases such as, for example, alkali metal hydroxides, aqueous ammonia and amines. As the chain transfer agents, there may be used mercaptan, carbon tetrachloride, chloroform and the like. Amount of the pH adjustor or chain transfer agent has no special limitation, but generally is 1 wt. % or less.

Emulsion polymerized compositions obtained by the methods mentioned above can be used as the emulsion polymer compositions for ink jet recording medium of the present invention.

Properties such as viscosity, concentration and pH of the emulsion polymer compositions in the present invention are not critical, but concentration is preferably at least 10%, especially preferably at least 20%, viscosity is preferably 80–2000 cps, especially preferably 100–1000 cps (at concentration 20% and temperature 20° C.) and pH is preferably 5–9.5, especially preferably 6–8.

When concentration is less than 10%, load for drying at coating is great and this results in undried coat in the case of coating in a given amount and thus good recording sheet cannot be obtained. Therefore, the higher concentration is desired. When viscosity is less than 80 cps, it is difficult to uniformly coat the composition in a given amount and uneven coating results on a transparent film. When viscosity is more than 2000 cps, also uneven coating occurs or patterns are formed. Thus, this is not preferred. With reference to pH, that of higher than neutral, that of lower than neutral or that of neutral area may be employed depending on kind of dyes used in inks and pH affects discoloration of recorded images on the recording sheet. Especially in case of color recording, four colors (black, cyan, magenta and yellow) for each of which optimum pH area changes depending on dyes used and so degree of discoloration of each of them is different. Thus, neutral pH area is preferred to balance these colors.

If necessary, additives such as, for example, wettability improver, defoamer, filler, preservative, freeze stabilizer and plastisizer may also be added to the emulsion polymer composition.

Furthermore, in order to improve shelf stability of ink jet recorded images, image stabilizers such as water resisting agent and light resisting agent (e.g., ultraviolet absorber, antioxidant and antiozonant) may also be added to the emulsion polymer composition.

However, it is necessary that addition of these additives does not damage light transmittance in view of the object of the present invention, though it may depend on addition amount and kind of additives. The addition amount has no special limitation, but preferably is 20 wt. % or less.

As the water-soluble resins which may be incorporated in the emulsion polymer composition at the time of coating, mention may be made of water-soluble resins which give a transparent film upon drying such as, for example, polyvinyl alcohol, gelatin and derivatives thereof, cellulose derivatives, e.g., sodium or ammonium salts of hydroxyethyl cellulose, methyl cellulose, hydroxypropyl cellulose, hydroxypropyl cellulose, hydroxypropylmethyl cellulose and carboxymethyl cellulose, acrylate copolymers and salts thereof, polyvinyl pyrrolidone and etherified starch. Addition amount of these resins is not critical, but preferably is equal to or less than that of the emulsion polymer composition.

According to the present invention, use of emulsion polymer composition obtained by emulsion polymerization of the monomer of the formula (I) using polyvinyl alcohol as an emulsifier gives effects on suitability of ink jet recording mentioned above and besides, use of the monomers of the formulas (I) and (II) in combination further results in improvement of adhesion to thermoplastic resin film.

Supports used in the present invention include, for example, transparent thermoplastic resin films, polyvinyl alcohol film, cellulose derivative films and stretched films thereof.

As the thermoplastic resin films, there may be used films of, for example, polyethylene terephthalate, polystyrene, polyvinyl chloride, polymethyl methacrylate, cellulose acetate, polyethylene and polycarbonate. In order to improve adhesion between the surface of these resin films and ink-receiving layer, preferably these films are provided with a subbing layer or subjected to corona discharge treatment.

The ink-receiving layer containing the emulsion polymer composition may be formed on the support by coating a coating composition comprising said emulsion polymer composition and other water-soluble resin and, if necessary, defoamer, dye, pH adjustor, preservative and the like on the support by generally used blade coater, air knife coater, roll coater, brush coater, curtain coater, bar coater, gravure coater, spraying device and the like and then drying the coat.

The ink-receiving layer of the recording sheet of the present invention may have a coverage of 0.5–30 g/m$^2$, preferably 1–15 g/m$^2$, more preferably 3–12 g/m$^2$.

Aqueous ink for ink jet recording is a recording liquid comprising the following colorant and liquid medium and other additives.

As the colorants, ordinary direct dyes, acid dyes, basic dyes, reactive dyes and water-soluble dyes such as food dyes may preferably be used.

As the media for aqueous ink, there may be used, for example, alkyl alcohols of 1–4 carbon atoms such as methyl alcohol, ethyl alcohol, n-propyl alcohol, isopropyl alcohol, n-butyl alcohol, sec-butyl alcohol, tert-butyl alcohol and isobutyl alcohol; amides such as dimethylformamide and dimethylacetamide; ketones or ketone alcohols such as acetone and diacetone alcohol; ethers such as tetrahydrofuran and dioxane; polyalkylene glycols such as polyethylene glycol and polypropylene glycol; alkylene glycols having alkylene of 2–6 carbon atoms such as ethylene glycol, propylene glycol, butylene glycol, triethylene glycol, 1,2,6-hexanetriol, thiodiglycol, hexylene glycol and diethylene glycol; and lower alkyl ethers of polyhydric alcohols such as glycerin, ethylene glycol methyl ether, diethylene glycol methyl (or ethyl) ether and triethylene glycol monomethyl ether.

Among these many water-soluble organic solvents, preferred are polyhydric alcohols such as diethylene glycol and lower alkyl ethers of polyhydric alcohols such as triethylene glycol monomethyl ether and triethylene glycol monoethyl ether. Other additives include pH adjustor, metal hindering agent, mildewproofing agent, viscosity modifier, surface tension adjustor, wetting agent, surfactant and rust preventive.

Problems of the conventional ink jet recording sheet suitable for light transmitting recording medium for overhead projector are mentioned hereinbefore. On the other hand, the emulsion polymer composition used as a main component of aqueous ink-receiving layer in the present invention is excellent in light transmittance and besides is superior to any conventional materials in absorbency of media for aqueous liquid and thus the recording sheet of the present invention is very suitable for ink jet recording.

The present invention is illustrated by the following examples where part and % are by weight unless otherwise notified.

EXAMPLE 1

In a four-necked separable flask equipped with a stirrer, a reflux condenser and a thermometer, 100 parts of PVA of 500 in polymerization degree and 87.2 mol. % in saponification degree was dissolved with heating in 1,200 parts of water and therein was charged 200 parts of mixed monomer comprising 140 parts of hydroxyethyl acrylate and 60 parts of butyl acrylate, followed by stirring to emulsify the mixed monomer. Then, 0.5 part of ammonium persulfate was added thereto to initiate polymerization and emulsion polymerization was effected for about 2 hours with keeping the reaction temperature at about 70° C. After completion of the reaction, the product was cooled to 40° C. or lower and then 10% aqueous sodium hydroxide solution was added thereto to obtain an emulsion polymer composition of concentration 20.1%, viscosity 115 cps and pH 7.8.

To 20 kg (effective ingredient 4 kg) of this emulsion polymer composition was added 20 g of a defoamer (trade name: Foamaster AP of Sun Nopco Co.), followed by well stirring. The resulting coating composition was coated on a corona discharge-treated polyester film of 100 μm thick at a coverage of 10 g/m$^2$ (solid content) by a roll coater and then dried to obtain a recording sheet. On this recording sheet, an image was recorded by an ink jet printer (IO-700) of Sharp Corporation to obtain a color image record free from unevenness and spread of ink and high in resolution and color density.

EXAMPLE 2

Using the same device as used in Example 1, 100 parts of PVA of 1,700 in polymerization degree and 89 mol. % in saponification degree was dissolved with heating in 1,200 parts of water and then, therein was charged 200 parts of the same mixed monomer as used in Example 1, followed by stirring to emulsify the mixed monomer. Further, 0.5 part of ammonium persulfate was added thereto to initiate polymerization and the emulsion polymerization was effected for about 2 hours with keeping the reaction temperature at about 70° C. After completion of the emulsion polymerization, the emulsion polymerization product was cooled to 40° C. or lower and 10% aqueous sodium hydroxide solution was added thereto to obtain an emulsion polymer composition having a concentration of 20.6%, a viscosity of 480 cps and a pH of 7.6.

To 20 kg (effective ingredient 4 kg) of this emulsion polymer composition was added 20 g of a defoamer (trade name: Foamaster AP of Sun Nopco Co.) followed by well stirring. Then, this was coated on a corona discharge treated polyester film of 75 μm thick at a converge of 12 g/m$^2$ (solid content) by a roll coater and dried to obtain a recording sheet.

On this recording sheet, an image was recorded by an ink jet printer (IO-700) of Sharp Corporation to obtain a color image record free from unevenness and spread of ink and high in resolution and color density, which was suitable for overhead projector.

EXAMPLES 3–7

Emulsion polymer compositions having the components as shown in Table 1 were prepared using the same device and emulsion polymerization method as used in Example 1.

Each of these compositions was coated by a roll coater and dried in the same manner as in Example 1 to obtain recording sheets.

On each of these recording sheets was recorded an image by an ink jet printer (I-700) of Sharp Corporation. The image dried in 30 seconds and there was obtained a color image record free from unevenness and spread of ink and high in resolution and color density and suitable for overhead projector.

EXAMPLE 8

On a polyester film of 100 μm thick having a nitrocellulose subbing layer was coated 15% aqueous solution containing 100 parts of emulsion polymer composition used in Example 1, 0.5 part of a defoamer (trade name: Foamaster AP of Sun Nopco Co.) and 30 parts of partially saponified polyvinyl alcohol (PVA205, saponification degree: 88 mol. % and polymerization degree: 500) at a coverage of 12 g/m$^2$ by Mayer bar and then dried to obtain a recording sheet. On this recording sheet was recorded an image by an ink jet printer (IO-700) of Sharp Corporation. The image dried in 30 seconds to obtain a color image record free from unevenness and spread of ink, high in resolution and color density and suitable for overhead projector.

COMPARATIVE EXAMPLES 1–4

Emulsion polymer compositions having the components as shown in Table 1 were prepared using the same device and emulsion polymerization method as employed in Example 1.

Using these emulsion polymer compositions, four recording sheets were prepared in the same manner as in Example 1. In Comparative Example 1, PVA was used in an amount of 2 times that of monomers and it was difficult to coat the desired amount of coating composition because of too low viscosity. In Comparative Examples 2 and 3, amount of PVA was too small and viscosity of coating composition was too high, resulting in uneven coating or patterns and the obtained sheets also had unevenness and patterns. Thus, these sheets were unsuitable for overhead projector. In Comparative Example 4, amount of compound of formula (II) was larger than that of compound of formula (I) and in this case film of ink-receiving layer was soft and inferior in blocking resistance under wet heat. This sheet was also unsuitable for overhead projector. On the sheet of Comparative Example 1 was recorded an image by an ink jet printer (I-700) of Sharp Corporation to find that ink was slow in drying and unevenness and spread of ink occurred. This recorded sheet was unsuitable as record sheet for overhead projector.

Composition and properties of the emulsion polymer compositions used in the above examples and comparative Examples are shown in Table 1.

TABLE 1

| | | Composition and properties of emulsion polymer composition | | | | | | | | | | |
|---|---|---|---|---|---|---|---|---|---|---|---|---|
| | | Example No. | | | | | | | | | | |
| | | Examples | | | | | | | Comparative Examples | | | |
| Monomers | | 1 & 8 | 2 | 3 | 4 | 5 | 6 | 7 | 1 | 2 | 3 | 4 |
| Formula (I) | Hydroxyethyl acrylate | 140 | 140 | | 70 | | 50 | 100 | 35 | 200 | 200 | 40 |
| | Hydroxypropyl acrylate | | | 210 | | 140 | | | | | | |
| | Diethylene glycol acrylate | | | | 70 | | | | | | | |
| Formula (II) | Buryl acrylate | 60 | 60 | 60 | 30 | 40 | 50 | | 15 | 200 | 100 | 60 |
| | Methyl methacrylate | | | 30 | | 10 | | | | | 100 | |
| Other | Acrylonitrile | | | | 30 | | | | | | | |
| | Acrylic acid | | | | | 10 | | | | | | |
| PVA | Polymerization degree 500 Saponification degree 87.2 mol. % | 100 | | 100 | 100 | 100 | 100 | 100 | 100 | 100 | 100 | |
| | Polymerization degree 1700 Saponification degree 89.0 mol. % | | 100 | | | | | | | | | |
| Properties of emulsion polymer composition | Concentration (%) | 20.1 | 20.6 | 20.4 | 20.6 | 20.5 | 20.3 | 20.7 | 20.1 | 20.5 | 20.6 | 20.4 |
| | Viscosity (cps) | 115 | 480 | 212 | 138 | 140 | 145 | | 48 | 2400 | 3900 | 135 |
| | pH | 7.8 | 7.6 | 7.5 | 7.4 | 7.8 | 7.3 | 7.5 | 7.8 | 7.9 | 7.8 | 7.4 |

EXAMPLE 9

An emulsion polymer composition was prepared in the same manner as in Example 1 except that 150 parts of dipropylene glycol methacrylate as compound of formula (I) and 40 parts of 2-ethylhexyl acrylate as compound of formula (II) and 100 parts of PVA (polymerization degree: 500 and saponification degree: 87.2 mol. %) were used. This composition had a concentration of 20.5%, a viscosity of 390 cps and a pH of 7.4. Further, a recording sheet was prepared using this composition in the same manner as in Example 1. The results were good as of Example 1.

The recording sheet of the present invention has a transparent ink-receiving layer on a transparent support and can absorb aqueous ink for ink jet recording and dry it in a short time. Therefore, this sheet can form a color image record of high resolution and high color density and is markedly excellent as a color image recording medium for overhead projector.

What is claimed is:

1. An ink jet recording sheet consisting essentially of a transparent support and, provided thereon, at least one ink-receiving layer which is a light transmission layer obtained by coating and drying an emulsion polymerized composition obtained by emulsion polymerization of (a) 100 parts by weight of a compound represented by the formula:

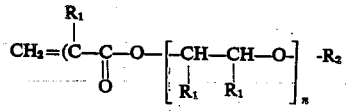

(I)

wherein $R_1$ represents a hydrogen atom, a methyl group, an ethyl group or a propyl group; $R_2$ represents a hydrogen atom r an alkyl group of 1–5 carbon atoms; and n represents an integer of 1–20 or (b) 100 parts by weight in total of the compound of the formula (I) and a compound represented by the formula:

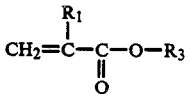

(II)

wherein $R_1$ is as defined above; and $R_3$ represents an alkyl group of 1–18 carbon atoms, with a proviso that the amount of the compound of the formula (II) is not more than that of the compound of the formula (I); and 30–100 parts by weight of polyvinyl alcohol as an emulsifier.

2. An ink jet recording sheet according to claim 1, wherein the compound of the formula (I) is at least one compound selected from the group consisting of hydroxyethyl acrylate, hydroxypropyl acrylate and diethylene glycol acrylate.

3. An ink jet recording sheet according to claim 1, wherein the compound of the formula (II) is at least one compound selected from the group consisting of butyl acrylate and methyl acrylate.

4. An ink jet recording sheet according to claim 1, wherein the emulsion polymerized composition has a viscosity of 80–2000 cps measured at a concentration of 20% and a temperature of 20° C. at the time of application to the support has been added.

5. A process for ink jet recording wherein an aqueous ink is applied to the ink jet recording sheet of claim 1.

* * * * *